US009791880B2

(12) United States Patent
Kumbaranthodiyil et al.

(10) Patent No.: US 9,791,880 B2
(45) Date of Patent: Oct. 17, 2017

(54) REDUCING VOLTAGE REGULATOR TRANSISTOR OPERATING TEMPERATURES

(71) Applicant: Analog Devices Global, Hamilton (BM)

(72) Inventors: Mahesh Madhavan Kumbaranthodiyil, Kerala (IN); Jeremy R. Gorbold, Newbury (GB)

(73) Assignee: Analog Devices Global, Hamilton (BM)

( * ) Notice: Subject to any disclaimer, the term of this patent is extended or adjusted under 35 U.S.C. 154(b) by 0 days.

(21) Appl. No.: 15/072,138

(22) Filed: Mar. 16, 2016

(65) Prior Publication Data

US 2017/0269623 A1 Sep. 21, 2017

(51) Int. Cl.
*G05F 3/24* (2006.01)
*G05F 3/18* (2006.01)

(52) U.S. Cl.
CPC ..... *G05F 3/185* (2013.01)

(58) Field of Classification Search
CPC ..... G05F 3/24; G05F 3/242; G05F 3/247
USPC ..... 323/269, 311, 315
See application file for complete search history.

(56) References Cited

U.S. PATENT DOCUMENTS 5,296,800 A * 3/1994 Bjorkman ..... G05F 1/563 323/268
6,603,157 B2 8/2003 Dupuy et al.
7,385,376 B2 6/2008 Zolfaghari
7,548,051 B1 6/2009 Tenbroeck et al.
7,554,306 B2 6/2009 Lee et al.
7,642,759 B2 1/2010 Dobkin

OTHER PUBLICATIONS

"16-Bit, Serial Input, Loop-Powered, 4mA to 20 mA DAC", Analog Devices Data Sheet—AD5421, (2014), 36 pgs.

* cited by examiner

*Primary Examiner* — Jeffrey Sterrett
(74) *Attorney, Agent, or Firm* — Schwegman Lundberg & Woessner, P.A.

(57) ABSTRACT

Methods and apparatus to reduce localized transistor operating temperature increases in fully integrated voltage regulator circuits are provided. Transistor self-heating effects are reduced by dispersing heat more evenly over the integrated circuit die, via use of nested voltage regulator circuits and/or use of more than one transistor in a voltage regulator circuit pass device. An electrically parallel-connected group of multiple individual integrated transistors may be laid out across cooler areas of the integrated circuit die, such as in substantially linear sets or rings of devices near the outer die perimeter. Each transistor in the group may better disperse its own heat if it is thermally segregated from other self-heating devices, as through a minimum physical layout spacing. Transistor bias voltage mismatch tolerances, load currents, and routing resistances may interrelatedly determine the number of individual transistors needed in a group.

27 Claims, 5 Drawing Sheets

REDUCING VOLTAGE REGULATOR TRANSISTOR OPERATING TEMPERATURES

TECHNICAL FIELD

This document relates to an improved integrated voltage regulator circuit design methodology that considers both the electrical and thermal behavior of integrated devices.

BACKGROUND

Voltage regulator circuits are widely used to provide a reliably controlled supply voltage for other circuits, such as in portable devices. A reference voltage generator circuit may generate a reference voltage from a supply voltage. A control circuit may compare the reference voltage to an output voltage and responsively adjust the output voltage, such as via a pass device such as a transistor. The output voltage may match or otherwise closely depend on the reference voltage, depending on the implementation, and may be quite different from the supply voltage. The pass device may be required to sustain a significant voltage drop while providing a significant output current. Such a voltage drop can lead to significant power dissipation by a pass device in the voltage regulator circuit, and corresponding self-heating consequences. Full integration of all the components of a voltage regulator circuit onto a single integrated circuit die therefore places interrelated constraints on maximum power dissipation, maximum ambient temperature, and maximum pass transistor operating temperature. Conventional layout approaches do not fully consider the thermal issues of a design.

OVERVIEW

The present inventors have recognized, among other things, that particular improvements of the voltage regulator circuitry used for example in integrated power electronics are possible. The improvements may be achieved by reducing the maximum operating temperature of pass devices in the voltage regulator circuitry such as via one or more distributed groups of individual integrated parallel-interconnected pass transistors. Different examples of thermal segregation are provided, such as to allow each transistor to better dissipate its own heat. The segregation may be achieved through distinctive layout practices that can help ensure that devices are spaced sufficiently apart and in cooler regions of the integrated circuit die, or away from die regions that are heat-sensitive. Further improvements may be achieved by distributing the voltage difference between a supply voltage and an output voltage across more than one voltage regulator circuit.

This document thus describes, among other things, a voltage regulator circuit approach that may help increase the maximum ambient temperature range capability, such as for a given total power dissipation. Similarly, the present approach may help increase a total power dissipation limit for a given maximum ambient temperature range, thereby allowing the circuit designer increased flexibility. Such a voltage regulator circuit approach may enable multiple additional advantages. For example, it may enable voltage regulation via fully integrated circuitry, without requiting an externally attached discrete transistor and associated external pin and heat sink concerns. This approach may also allow integration of voltage regulator circuits with other integrated circuits that may otherwise have been too thermally sensitive for integration onto the same integrated circuit die as the voltage regulator circuits.

In an example, an integrated circuit for regulating an input voltage may include a reference voltage generation circuit that generates a reference voltage from the input voltage, and a source follower circuit including an integrated field-effect transistor that receives the input voltage at its drain node, receives the reference voltage at its gate node, and provides a regulated output voltage at its source node. The integrated field-effect transistor may include an electrically parallel-interconnected group of multiple individual integrated field-effect transistors that are thermally segregated to reduce individual transistor operating temperature increases from self-heating. The thermal segregation may be accomplished by spatially separating the transistors on an integrated circuit die.

In an example, a method for reducing individual transistor operating temperature increases from self-heating in a voltage regulator integrated circuit may include generating a reference voltage from an input voltage using a reference voltage generation circuit, and regulating an output voltage using a source follower circuit. The source follower circuit may include an integrated field-effect transistor that receives the input voltage at its drain node, receives the reference voltage at its gate node, and provides a regulated output voltage at its source node. The method may also include thermally segregating an electrically parallel-connected group of multiple individual integrated field-effect transistors that comprise the integrated field-effect transistor. The thermally segregating may include spatially separating the transistors on an integrated circuit die.

In an example, a system may include means for reducing transistor operating temperatures in a voltage regulator integrated circuit. The system may include for example means for regulating an input voltage based on a reference voltage to produce a regulated output voltage. The system may also include means for thermally segregating an electrically parallel-connected group of multiple individual integrated field-effect transistors that regulate the output voltage, by spatially separating the transistors on an integrated circuit die.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
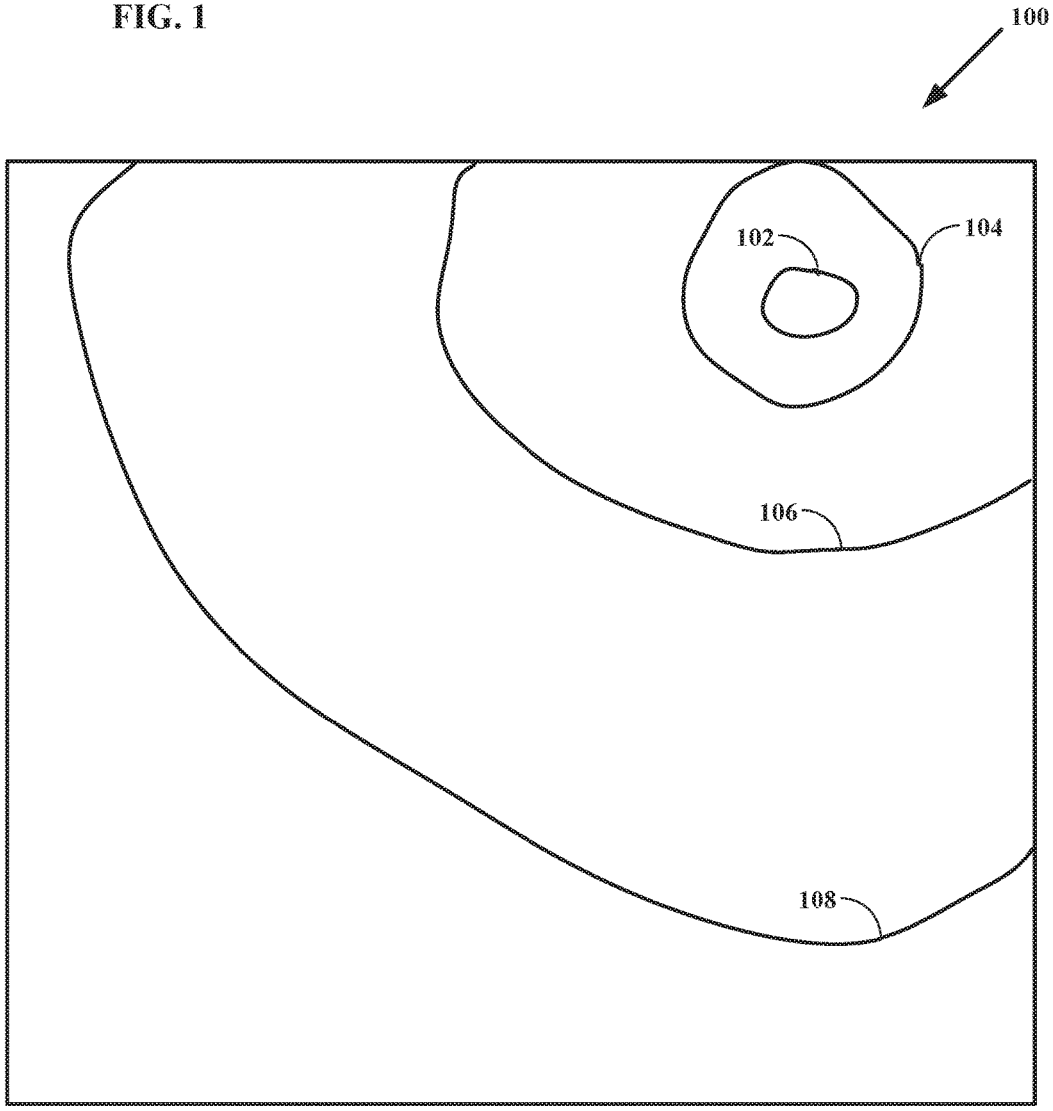
FIG. 1 shows an example of a computer-simulated thermal map of an integrated circuit 100 including a voltage regulator circuit.

FIG. 1 shows an example of a computer-simulated thermal map of an integrated circuit 100 including a voltage regulator circuit. In this example, a low-dropout voltage regulator circuit, e.g., capable of operating from a supply voltage only one volt higher than its output voltage, was located in the upper right area of the layout of the integrated circuit 100. The integrated circuit 100 die may be mounted on an exposed paddle package, a package type that can be used for voltage regulator integrated circuits.

Operation of the integrated circuit 100 was computer-simulated, both electrically and thermally. The low-dropout voltage regulator circuit was desired to sustain fifty-five volts on its integrated pass device and to supply twenty-five milliamperes of output current in this example. Such high pass device voltages are needed in some applications, such as when the supply voltage is provided from a rechargeable lithium battery.

The simulated isotherm 102 near the low-dropout voltage regulator circuit indicates an area of the integrated circuit 100 that was thirty-two Celsius degrees higher than the ambient temperature. Isotherms 104, 106, and 108 show boundaries where portions of the integrated circuit 100 were simulated as twenty-four, sixteen, and eight Celsius degrees above ambient, respectively. The pass transistor in the voltage regulator circuit, as well as devices laid out near the pass transistor, may therefore operate at much higher temperatures than devices that are farther away from the pass transistor. The lower left corner of the integrated circuit 100 die, opposite the pass device, for example, was notably cooler than the area where the pass device was located.

The mean time to failure for individual transistors is strongly related to increased transistor operating temperatures, with higher operating temperatures leading to sharply decreased transistor reliability. Thus, even a relatively small reduction in transistor operating temperatures may be quite important for circuit reliability. The concentrated self-heating effects from the voltage regulator circuit may therefore set the maximum operating temperature of an integrated circuit 100 die as a whole. For this reason, in some voltage regulator circuits, the pass device is not integrated with the rest of the voltage regulator circuit, but is instead separately attached as a discrete transistor.

This partial-integration approach has several disadvantages. First, the part count is increased, from a single integrated circuit to also including the separate discrete device. Second, the separate discrete device may need to be attached to a separate heat sink for sufficient power dissipation. Third, additional external integrated circuit pins need to be provided for electrical attachment of the separate discrete device to the integrated circuit. Avoiding these issues through full integration may however lead to more difficult heat management issues, as previously described.

Figure 2:
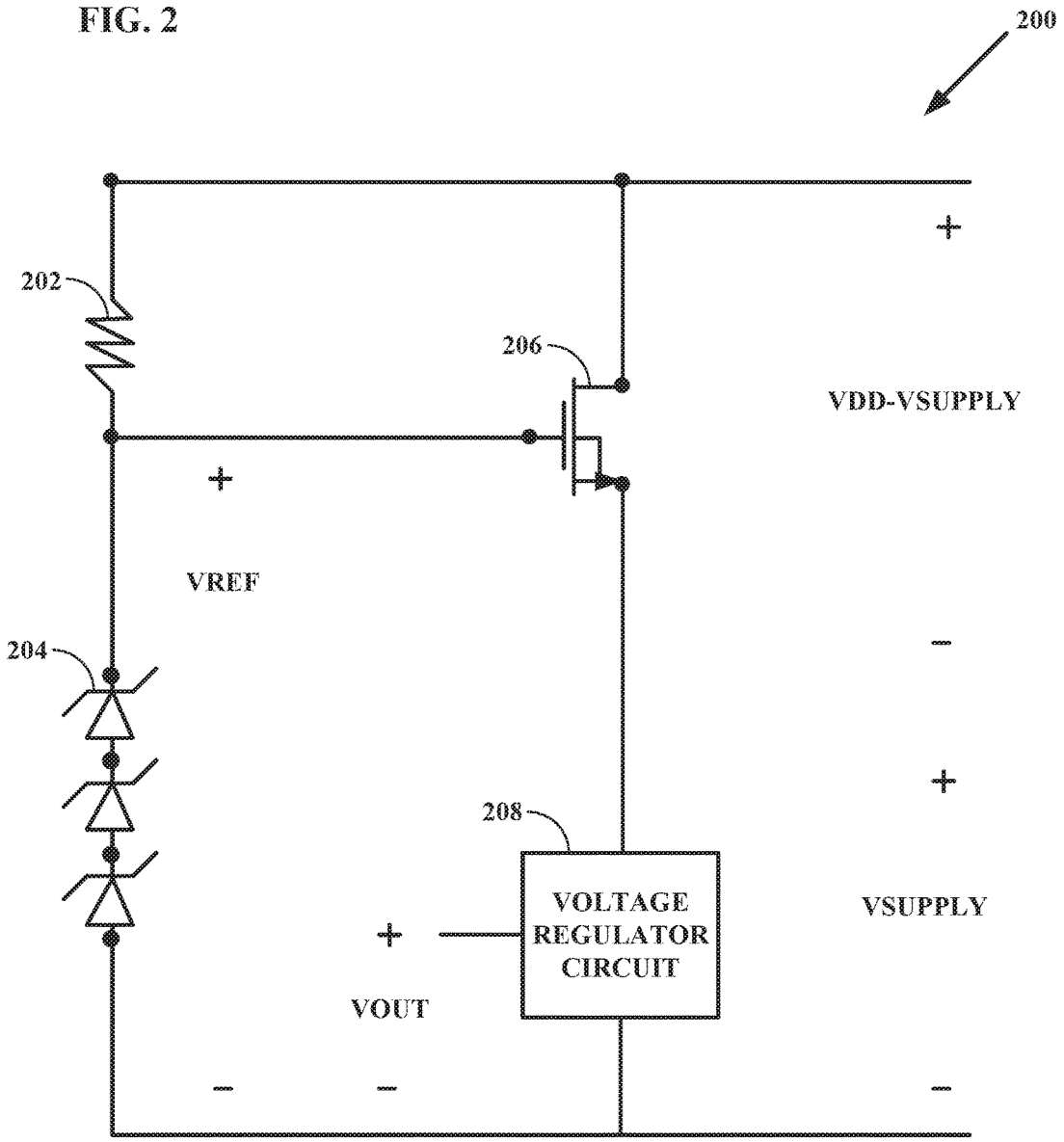
FIG. 2 shows an example of a voltage regulator circuit 200 that can include a reference voltage generation circuit 202-204 and a pass transistor 206 that can provide its output voltage as a supply voltage to a second voltage regulator circuit 208.

FIG. 2 shows an example of a voltage regulator circuit 200 that can include a reference voltage generation circuit 202-204 and a pass transistor 206 that can provide its output voltage as a supply voltage to a second voltage regulator circuit 208. The first voltage regulator circuit 202-206, which can be a source follower, may act as a "pre-regulator" that primarily provides voltage reduction.

The voltage regulator circuit 200 may be powered by an input positive supply voltage VDD. The reference voltage generation circuit shown may generate reference voltage VREF such as across a number of series-connected Zener diodes 204 connected to VDD such as via resistor 202. The reference voltage generation circuit shown is exemplary but not limiting.

Reference voltage VREF may be provided to the gate node of pass device 206. The pass device 206 can include an n-channel field-effect transistor, such as an n-channel lateral diffused channel MOS device, but such an example is not limiting. A bipolar junction transistor for example, or other type of pass device may be used instead.

Pass device 206 may perform several functions in this example. Pass device 206 may provide its current to a load, which in this instance can comprise the second voltage regulator circuit 208. Since pass device 206 requires no DC gate current, it may also act as an excellent control device that can sense the generated reference voltage VREF at its gate node, and the drain-gate voltage across the resistor 202, and can responsively control the source node voltage VSUPPLY. Pass device 206 may reduce the positive supply voltage VDU at its drain node to a lower voltage VSUPPLY at its source node by maintaining the voltage drop VDD-VSUPPLY as a drain-source voltage. The first voltage regulator circuit 202-206 thus may not need to be as precise in its regulation of output voltage VSUPPLY, because the second voltage regulator circuit 208 will further regulate VSUPPLY down to VOUT.

The second voltage regulator circuit 208 may comprise a low-dropout voltage regulator circuit, so that VSUPPLY may need to exceed VOUT by, e.g., only one volt for proper operation. The second voltage regulator circuit 208 may be of the same or similar design as the first voltage regulator circuit 202-206, or it may be of a different arrangement. The second voltage regulator circuit 208 may include its own voltage generation circuit and pass device.

The second voltage regulator circuit 208 may produce a regulated output voltage VOLT' from the supply voltage VSUPPLY, which has been reduced from VDD and regulated by pass device 206. The second voltage regulator circuit 208 may therefore use a pass device that sustains only the VSUPPLY-VOUT voltage, rather than the full VDD-VOUT voltage that would otherwise be required. The second voltage regulator circuit 208 may therefore be allowed to dissipate less power overall. Voltage regulator circuit 200 thus may enable increased heat management design flexibility by allowing a designer more flexibility to determine how the overall power dissipation is to be distributed between the multiple voltage regulator circuits. For example, the designer may decide to distribute power dissipation equally among two voltage regulator circuits, and may place each voltage regulator circuit in an opposite corner of an integrated circuit die.

Further, the stability of the second voltage regulator circuit 208 may be substantially independent of the first voltage regulator circuit 202-206, since it is powered via the relatively low impedance output of the source follower circuit. The source follower circuit may not require either an internal or external compensation capacitor for stability.

This may make it easier to select a particular voltage regulator circuit for use as the second voltage regulator circuit 208.

The nested voltage regulator stage approach described above may enable additional advantages. For example, by controlling the first voltage regulator circuit pass transistor gate voltage rise, a designer may reduce the problems that may occur when there are fast supply voltage ramps, such as when the voltage regulator circuit is first initialized. Further, controlling the first voltage regulator circuit pass transistor gate voltage rise may help control the initial inrush current that charges a load capacitor or a compensation capacitor to the provided supply voltage.

Figure 3:
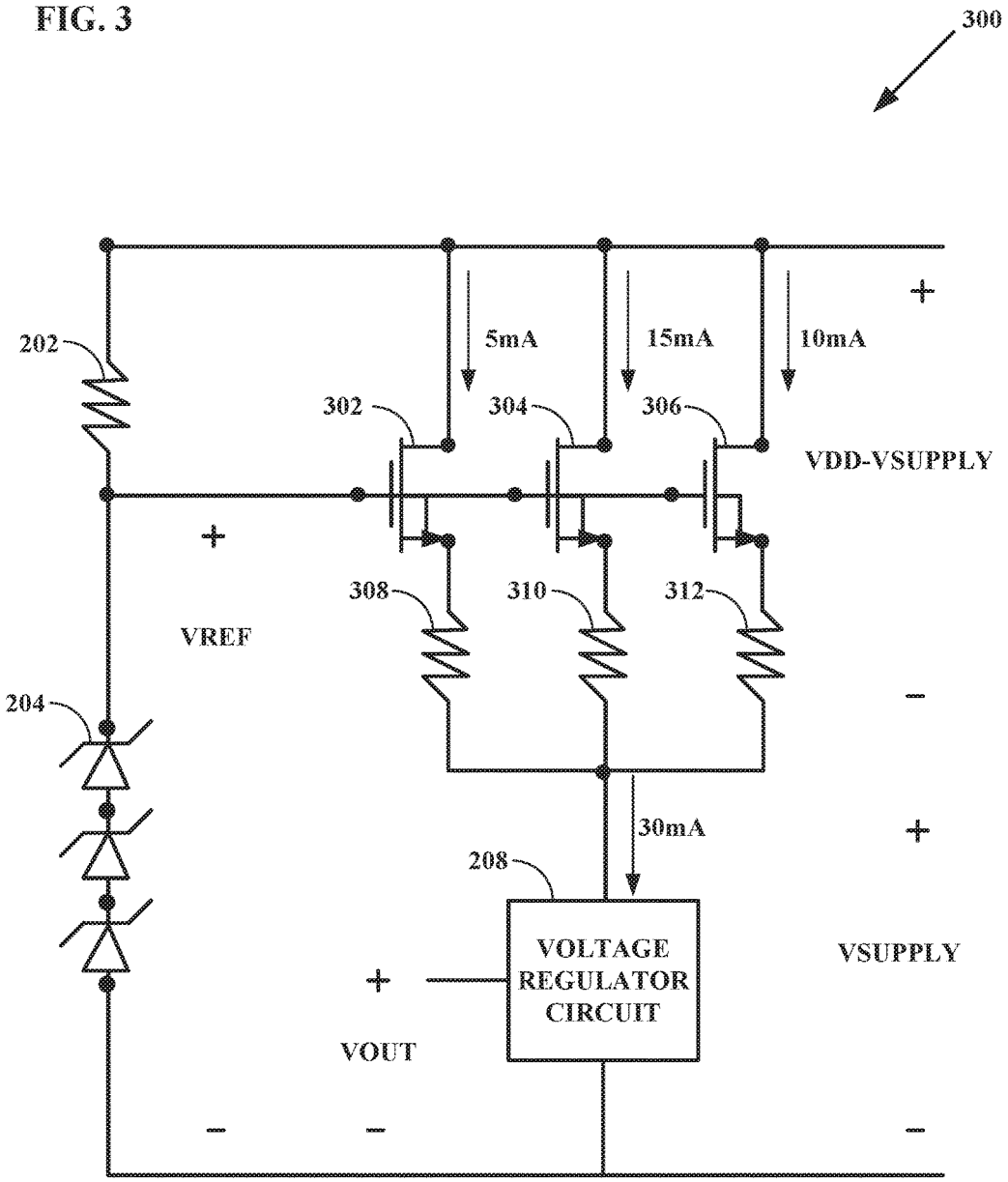
FIG. 3 shows an example of a voltage regulator circuit 300 that includes the reference voltage generation circuit 202-204 and a group of pass transistors 302-306 that provide an output voltage as a supply voltage to the second voltage regulator circuit 208.

FIG. 3 shows an example of a voltage regulator circuit 300 that includes the reference voltage generation circuit 202-204 and a group of pass transistors 302-306 that provide an output voltage as a supply voltage to the second voltage regulator circuit 208. This example replaces the single pass transistor 206 of FIG. 2 with a group of multiple individual integrated transistors that may be electrically connected in parallel. The pass transistors 302-306 may however be spatially distributed in different locations on the integrated circuit 100 die for heat dispersion.

This approach may normalize or more evenly or equally distribute heat dissipation across the entire integrated circuit die, rather than merely constraining the total power that can be dissipated. The distributed pass transistor group may actually comprise a large number, e.g., one hundred or more, of individual integrated transistors that are electrically interconnected in parallel. Each individual integrated transistor may be physically separated or spaced apart from other individual integrated transistors or other circuitry on the integrated circuit die by a minimum distance during the layout process.

Thermal consequences are not always considered during layout generations, which otherwise generally prioritizes integrated circuit area requirement optimizations over uniform heat dispersion. A layout device spacing requirement that considers the operating temperatures of the individual integrated transistors in a distributed pass transistor group may therefore lead to unconventional circuit placements. This approach may however provide the designer with further flexibility for managing not only the electrical performance but also the thermal performance of the integrated circuit. Similarly, a layout device spacing requirement that considers the operating temperature gradient across a group of individual integrated transistors may lead to more even heat dispersion.

In FIG. 3, the pass transistors 302-306 are shown in the first voltage regulator circuit (or "pre-regulator" circuit), but this example is not limiting. The second voltage regulator circuit 208 may use multiple individual integrated transistors, such as can be electrically connected in parallel to form its composite pass device. However, it is possible that this practice may introduce parasitic resistances and capacitances on its equivalent pass transistor gate, which could impact the stability of the second voltage regulator circuit 208. Careful management of such parasitics may help ensure that low capacitive loads may be properly stabilized by the second voltage regulator circuit 208 for a given load current.

FIG. 3 also shows a set of source resistors 308-312. Each of these resistors may be added deliberately by the designer, or their values may depend solely or in part on interconnect routing resistance such that their values may vary based on the particular layout routing used. Each source resistor may connect from a corresponding individual integrated transistor to a common node.

In this illustrative example, a total of thirty milliamperes of current is to be provided to the second voltage regulator circuit 208. However, it is possible, as shown, that there may be unequal currents provided by each of the individual integrated transistors 302-306. Again, this may be a deliberate choice, implemented for example by selecting the size of each individual transistor. This can provide increased flexibility in determining where power is to be dissipated, e.g., in which of the individual transistors and in which source resistors, as well as in which voltage regulator circuit. However, it is possible that unintentionally unequal source resistor 308-312 values may also play a role in current distribution.

In an example, the maximum transistor bias voltage mismatch that may occur because of source resistance value mismatch may factor into the choices regarding the number of similar individual transistors to be used. Suppose that for an acceptable match in drain current values, a gate-source voltage mismatch between similar individual transistors of five millivolts may be tolerated. This transistor gate-source voltage mismatch may cause a similar voltage mismatch across the similar source resistors 308-312. If the source resistance value mismatch for similar source resistors in a given layout is sixteen ohms, the drain current of each individual transistor may be approximately five millivolts divided by sixteen ohms, or three hundred microamperes. If the group of similar transistors is to provide a total current of thirty milliamperes to the load (e.g., the second voltage regulator circuit 208), then one hundred such similar individual transistors may be connected in parallel such that the tolerable gate-source voltage mismatch is not exceeded.

When the number of individual devices becomes large, similar individual transistors can be used in layouts that tend to provide similar source resistance values. The multiple individual transistors can be arranged in a substantially linear set or a ring or other geometric arrangement, such as that can distribute both current and heat dissipation in an easily manageable and reliably manufacturable way. Although a complete electrical and thermal simulation of an entire integrated circuit 100 may be feasible, it may be too computationally expensive to include in each design iteration. Layout spacing rules for groups of individual integrated devices connected in parallel to form a pass device may be different from the layout spacing rules for other circuitry. The layout rules for self-heating devices may emphasize heat dispersion far more than simple area optimization.

Figure 4:
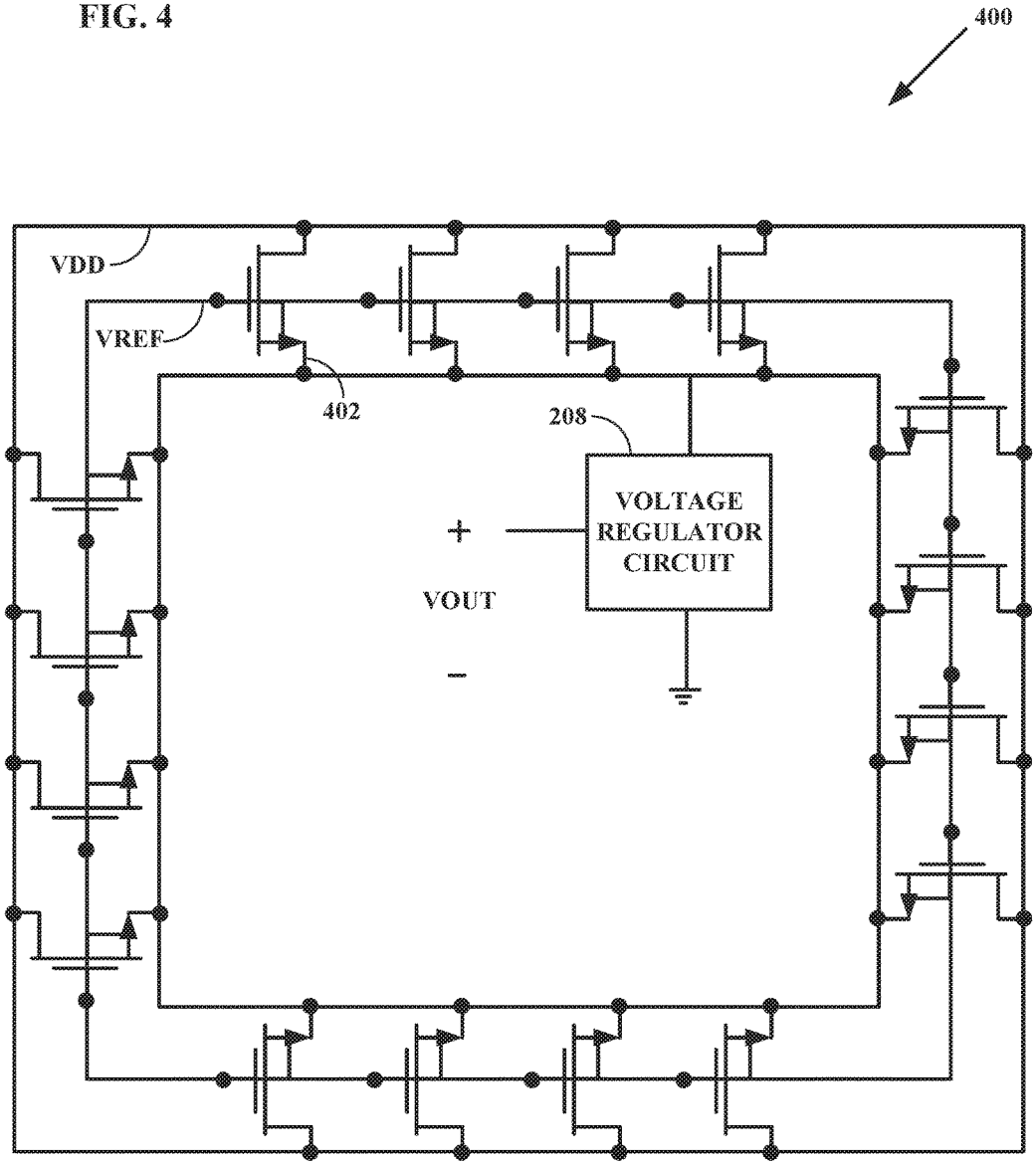
FIG. 4 shows an example of a voltage regulator circuit 400 integrated circuit die, with a group of pass transistors 402 that can be laid out around the perimeter of the integrated circuit die such as to provide an output voltage as a supply voltage to the second voltage regulator circuit 208.

FIG. 4 shows an example of a voltage regulator circuit 400 integrated circuit die, with a group of pass transistors 402 that can be laid out around the perimeter of the integrated circuit die such as to provide an output voltage as a supply voltage to the second voltage regulator circuit 208. Another load may replace the second voltage regulator circuit 208 if desired. As in previous examples, input voltage VDD can be provided to the integrated circuit, and a first voltage regulator circuit may generate reference voltage VREF. The first voltage regulator circuit may include a large number of individual integrated transistors connected in parallel.

In FIG. 4, only sixteen individual integrated transistors are shown for clarity, but another number of individual integrated transistors may be used, e.g., a hundred or more. The transistors 402 may be identical, and may have equal source resistance values to keep the electrical design more manageable, if desired. The transistors 402 may be spatially distributed around the outer perimeter of the integrated circuit 100 die in a ring in an example, which may place them near the bond pads. In an example, the transistors 402 may be spatially distributed in one or more substantially linear sets along one or more outer edges of the integrated circuit 100 die, e.g., again near the bond pads. The edges chosen for placement of self-heating devices may correspond to the cooler edges as shown for example in FIG. 1.

In general, the transistors 402 may be spatially distributed to take advantage of less self-heated regions of the integrated circuit 100 die to more closely approximate a fully uniform dispersion of heat. The transistors 402 may be spatially distributed to best reduce their operating temperatures or to best reduce an operating temperature gradient across a number of the transistors 402, and thus ameliorate self-heating issues. The cooler regions may also be in areas other than the perimeter regions of the integrated circuit 100 die, depending on the power dissipation of other circuitry. The sensitivity of other circuitry to changes in temperature may also help determine the placement of the transistors 402. For example, a designer or a thermal-based layout tool may place devices for a voltage reference generation circuit in different physically-separated locations than the parallel-connected transistors that form a pass device.

In some instances, electrostatic discharge devices may be added to the group or groups of individual integrated transistors in the voltage regulator circuit or circuits. Such devices may protect the transistors from damage due to temporary transients (such as may be experienced when the pass transistors are placed at the periphery of an integrated circuit die, e.g., within a bond pad ring) and may comprise Zener gate node protection diodes, for example. It may not be necessary to provide an electrostatic discharge device for each individual integrated transistor. Instead, a single electrostatic discharge device may protect a specified number, e.g., ten, of the individual integrated transistors, for example.

Figure 5:
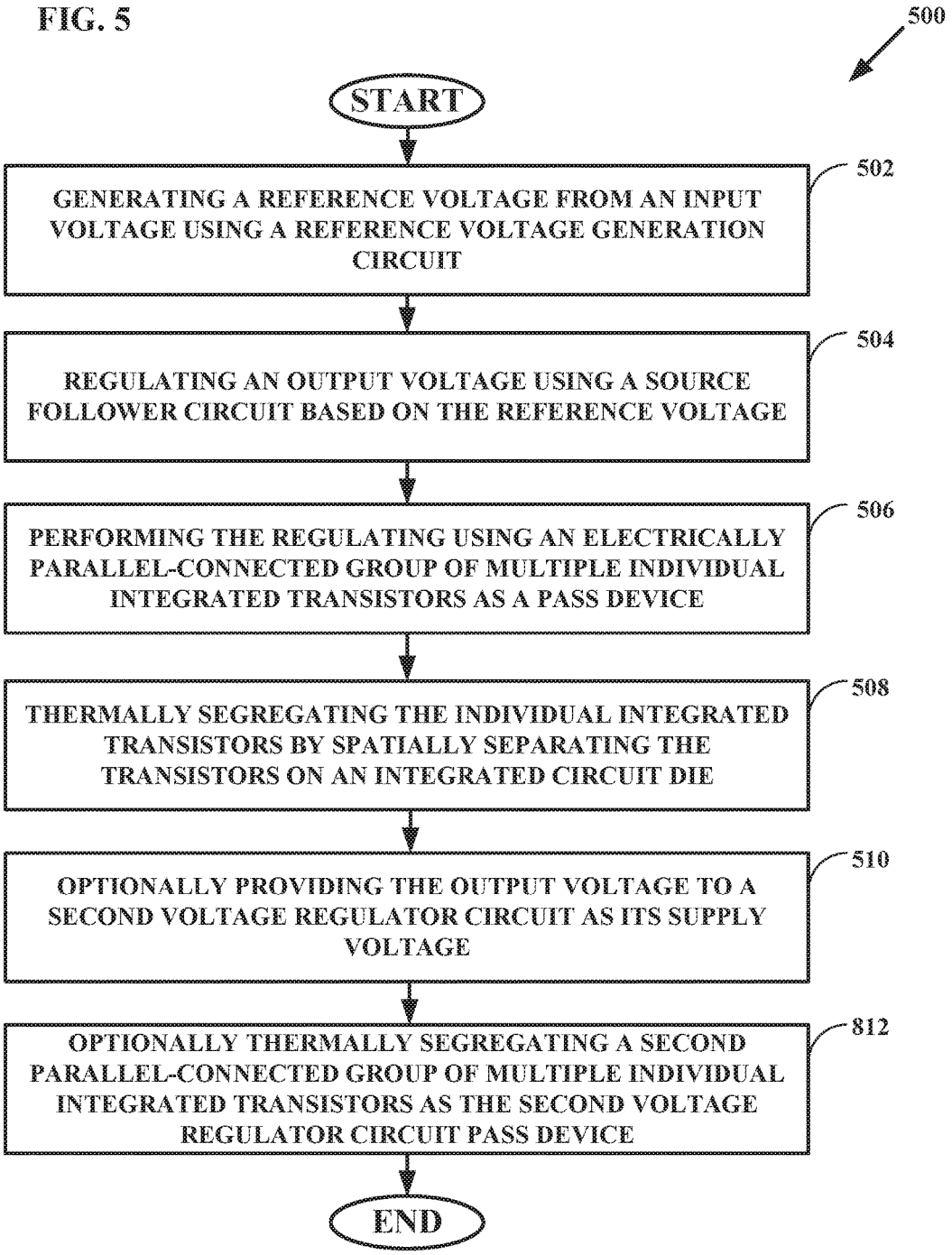
FIG. 5 shows an example of a voltage regulation method 500.

FIG. 5 shows an example of a voltage regulation method 500. At 502, the method may include generating a reference voltage from an input voltage, such as a supply voltage, using a reference voltage generation circuit. At 504, the method may further include regulating an output voltage using a source follower circuit (or emitter follower circuit if bipolar transistors are used), based on the reference voltage.

At 506, the method may further include performing the regulating using an electrically parallel-connected group of multiple individual integrated transistors as a pass device. At 508, the method may further include thermally segregating the individual integrated transistors such as by spatially separating them on an integrated circuit die, so that each may disperse its heat more independently. The separation may decrease or minimize the operating temperatures of the transistors, or decrease or minimize an operating temperature gradient, or otherwise more closely approximate a uniform heat dispersion across the integrated circuit die. The separation may also be based on the proximity to temperature-critical areas of an integrated circuit design.

At 510, the method may further include providing the output voltage to a second voltage regulator circuit as its supply voltage. At 512, the method may further include thermally segregating a second electrically parallel-connected group of multiple individual integrated transistors as a pass device for the second voltage regulator circuit.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) still encompassed by this description.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An integrated circuit for regulating an input voltage, the integrated circuit comprising:

a reference voltage generation circuit that generates a reference voltage from the input voltage; and a source follower circuit comprising an integrated field-effect transistor that receives the input voltage at its drain node, receives the reference voltage at its gate node, and provides a regulated output voltage at its source node, wherein the integrated field-effect transistor comprises an electrically parallel-interconnected group of multiple individual integrated field-effect transistors that are thermally segregated to reduce individual transistor operating temperature increases from self-heating by spatially separating the transistors on an integrated circuit die.

2. The integrated circuit of claim 1 wherein the transistors are positioned in a ring around a perimeter of the integrated circuit die.

3. The integrated circuit of claim 1 wherein the transistors are positioned in at least one substantially linear set along at least one outer edge of the integrated circuit die.

4. The integrated circuit of claim 1 further comprising a second voltage regulator circuit that receives the regulated output voltage as its supply voltage and provides a second regulated output voltage.

5. The integrated circuit of claim 4 wherein at least one of the regulated output voltage and the second regulated output voltage is provided by a low dropout voltage regulator circuit that operates with a voltage difference between its supply voltage and its output voltage as low as one volt.

6. The integrated circuit of claim 4 wherein the second voltage regulator circuit comprises:

a second reference voltage generation circuit that generates a second reference voltage from the supply voltage; and a second source follower circuit comprising a second integrated field-effect transistor that receives the supply voltage at its drain node; receives the second reference voltage at its gate node, and provides the second regulated output voltage at its source node.

7. The integrated circuit of claim 6 wherein the second integrated field-effect transistor comprises a second electrically parallel-interconnected group of individual integrated transistors that are thermally segregated.

8. The integrated circuit of claim 7 wherein at least one of the group and the second group comprise n-channel lateral diffused channel transistors.

9. The integrated circuit of claim 1 further comprising source resistors each connected between a source node of each individual integrated transistor and a common output node that provides the regulated output voltage.

10. The integrated circuit of claim 9 wherein the source resistors comprise interconnect routing resistances.

11. A method of reducing individual transistor operating temperature increases from self-heating in a voltage regulator integrated circuit, the method comprising:

generating a reference voltage from an input voltage using a reference voltage generation circuit;

regulating an output voltage using a source follower circuit comprising an integrated field-effect transistor that receives the input voltage at its drain node, receives the reference voltage at its gate node, and provides a regulated output voltage at its source node; and thermally segregating an electrically parallel-connected group of multiple individual integrated field-effect transistors that comprise the integrated field-effect transistor, by spatially separating the transistors on an integrated circuit die.

12. The method of claim 11 wherein the transistors are positioned in a ring around a perimeter of the integrated circuit die.

13. The method of claim 11 wherein the transistors are positioned in at least one substantially linear set along at least one outer edge of the integrated circuit die.

14. The method of claim 11 wherein the regulating further comprises using a second voltage regulator circuit that receives the regulated output voltage as its supply voltage and provides a second regulated output voltage.

15. The method of claim 14 wherein at least one of the regulated output voltage and the second regulated output voltage is provided by a low dropout voltage regulator circuit that operates with a voltage difference between its supply voltage and its output voltage as low as one volt.

16. The method of claim 14 wherein the second voltage regulator circuit:

generates a second reference voltage from the supply voltage using a second reference voltage generation circuit; and regulates a second regulated output voltage using a second source follower circuit comprising a second integrated field-effect transistor that receives the supply voltage at its drain node, receives the second reference voltage at its gate node, and provides the second regulated output voltage at its source node.

17. The method of claim 11 wherein the transistors comprise n-channel lateral diffused channel integrated transistors.

18. The method of claim 17 further comprising using interconnect routing resistances for the source resistors.

19. The method of claim 11 further comprising stabilizing the regulated output voltage with source resistors each connected between a source node of each individual integrated transistor and a common output node that provides the regulated output voltage.

20. A system for reducing transistor operating temperatures in a voltage regulator integrated circuit, the system comprising:

means for regulating an input voltage based on a reference voltage to produce a regulated output voltage; and means for thermally segregating an electrically parallel-connected group of multiple individual integrated field-effect transistors that regulate the output voltage, by spatially separating the transistors on an integrated circuit die.

21. A voltage regulator circuit to provide a reduced operating temperature, the voltage regulator circuit comprising:

one or more distributed groups of individual pass transistors, wherein individual pass transistors are theminaily segregated to reduce individual transistor operating temperature increases from self-heating by spatially separating the transistors on an integrated circuit die.

22. The voltage regulator circuit of claim 21, wherein the distributed groups of individual pass transistors are interconnected in parallel.

23. The voltage regulator circuit of claim 21, further comprising:

a reference voltage generation circuit that generates a reference output voltage from the input voltage.

24. The voltage regulator circuit of claim 21, wherein the thermal segregation includes locating the pass transistors away from a heatsensitive region of the integrated circuit die.

25. The voltage regulator circuit of claim 21, wherein the pass transistors are spatially separated by distributing the pass transistors to different locations on the integrated circuit die for increased heat dispersion.

26. The voltage regulator circuit of claim 25, wherein at least some of the pass transistors are located in a ring around a perimeter of the integrated circuit die.

27. The voltage regulator circuit of claim 25, wherein at least some of the pass transistors are located in at least one substantially linear set along at least one outer edge of the integrated circuit die.

* * * * *